US006120208A

United States Patent [19]

Hong

[11] Patent Number: 6,120,208

[45] Date of Patent: Sep. 19, 2000

[54] PREFABRICATION TYPE HIGH LEVEL ROAD STRUCTURE AND CONSTRUCTION METHOD THEREOF

[76] Inventor: Wan-Ki Hong, 1006, Ra-dong, Sora Apartment, Bangbae-dong, Soch'o-gu, Seoul, Rep. of Korea

[21] Appl. No.: 09/011,860

[22] PCT Filed: Aug. 20, 1996

[86] PCT No.: PCT/KR96/00139

§ 371 Date: Feb. 17, 1998

§ 102(e) Date: Feb. 17, 1998

[87] PCT Pub. No.: WO97/07284

PCT Pub. Date: Feb. 27, 1997

[30] Foreign Application Priority Data

Aug. 21, 1995 [KR] Rep. of Korea ..... 95-25693

[51] Int. Cl.[7] ..... E01D 19/00

[52] U.S. Cl. ..... 404/1; 404/6; 404/73; 14/75; 14/77.1

[58] Field of Search ..... 14/77.1, 77.3, 14/78, 75; 404/28, 29, 71, 1, 6, 73

[56] References Cited

U.S. PATENT DOCUMENTS

| | | | |
|---|---|---|---|
| 2,184,137 | 12/1939 | Brewer . | |
| 3,712,187 | 1/1973 | Stelling | 404/3 |
| 4,826,076 | 5/1989 | Hesse | 238/10 R |
| 5,131,786 | 7/1992 | House et al. | 404/6 |
| 5,406,663 | 4/1995 | Chen | 14/75 |
| 5,771,518 | 6/1998 | Roberts | 14/73.1 |
| 5,863,148 | 1/1999 | Shivaram | 404/28 |
| 5,870,789 | 2/1999 | Carranza-Aubry | 14/73 |

*Primary Examiner*—James A. Lisehora

*Attorney, Agent, or Firm*—R. Neil Sudol; Henry D. Coleman

[57] ABSTRACT

An improved prefabricated elevated highway structure and a construction method thereof by which an elevated highway can be more easily and rapidly constructed without causing traffic congestion at a construction site, which highway includes an underground section for stably supporting the elevated highway and for effectively distributing the weight of the same to the ground; a plurality of support sections spaced from one another along a road on which the prefabricated elevated highway is constructed; a pavement section formed on the upper portion of the support sections; and a wall section formed at both sides of the road and along the pavement section.

29 Claims, 19 Drawing Sheets

PREFABRICATION TYPE HIGH LEVEL ROAD STRUCTURE AND CONSTRUCTION METHOD THEREOF

TECHNICAL FIELD

The present invention relates to a prefabrication type high level road structure and a construction method thereof, and particularly to an improved prefabrication type high level road structure and a construction method thereof by which a high level road can be more easily and rapidly constructed without causing a traffic jam at the construction site of a high level road by transferring elements of the road structure which elements are fabricated in a remote site and assembling the elements at the construction site.

BACKGROUND ART

As well known to those skilled in the art, a high level road has many advantages to a country having a small area. That is, the high level road has a relatively high traffic jam-distributing effect per a unit area of the road.

Particularly, in an attempt to effectively cope with the problems that the number of cars is sharply increased, the high level road becomes a good solution for a heavy traffic jam in a limited area. In addition, for resolving the above-mentioned traffic jam problems, a predetermined area should be additionally expanded for a new road.

However, the conventional construction method of a high level road has many disadvantages. That is, since the conventional construction method is directed to setting up a concrete-made support at the center or at both sides of the road, on which a high level road is constructed, assembling steel beams and supports around the concrete-made support, and fabricating a concrete-made road surface thereon, the road occupying rate is very high at the construction site for constructing the high level road, and the construction period is very lengthy, thus increasing the construction cost.

Due to the above-mentioned problems, the construction cost is increased and a heavy traffic jam is caused at the construction site of the high level road during the construction period of the same.

Therefore, a new construction method of a high level road is ungently needed in the industrial field so as to overcome the above-mentioned problems.

As requirements for a new construction method, the elements of the high level road structure are previously fabricated at a remote site and transferred to the construction site and are then assembled at the construction site.

So as to satisfy the above-mentioned requirement, a prefabrication type high level road construction method may be considered.

The prefabrication type high level road has advantages in that it is possible to shorten the construction period, and to reduce the construction cost. In addition, defected parts can be rapidly changed.

The prefabrication type high level road construction is not known to people. There is only one method for temporally fabricating such a road for forming a passenger path at the construction site or the like.

The important thing of the prefabrication type high level road construction method is how to effectively distribute the total weight applied to the road surface. The total weight and load are applied to the underground section through the supports supporting the roads. It is necessary to minimize the occupying area of the road and to simplify the structure of the road, thus improving the assembly process and the like.

DISCLOSURE OF THE INVENTION

Accordingly, it is an object of the present invention to provide a prefabrication type high level road structure and a construction method thereof, which overcomes the problems encountered in a conventional high level road structure and a construction method thereof.

It is another object of the present invention to provide a prefabrication type high level road structure and a method thereof by which a conventional high level road structure and a construction method thereof can be significantly improved, as compared to the conventional art which is directed to temporally setting up a high level road so as to provide a temporary road.

It is another object of the present invention to provide a prefabrication type high level road structure and a method thereof by which a weight including cars and the structure of the same applied to the supports through a road area can be significantly/effectively reduced. That is, it is possible to reduce the road utilizing rate of the road without additionally expanding the area for a new high level road. Moreover, it is possible to more easily construct a high level road.

It is another object of the present invention to provide a prefabrication type high level road structure and a method thereof by which a more stable and reliable high level road can be constructed by effectively distributing the total weight of the high level road.

It is another object of the present invention to provide a prefabrication type high level road structure and a method thereof by which a construction period of a high level road can be significantly reduced, and it is possible to construct a high level road at a limited area.

To achieve the above objects, there is provided a prefabrication type high level road structure, which includes a underground section for stably supporting the total weight of the high level structure and vehicle thereon and for distributing the total weight thereof; a support section vertically standing on the road, on which the high level road is constructed, along the road and spaced-apart from one another by a predetermined distance; and a pavement section mounted on the supports.

To achieve the above objects, there is provided a prefabrication type high level road structure construction method, which includes the steps of forming a underground section by evacuating or excavating a predetermined foundation zone or area of the ground, disposing buried rails therein in a direction of travel of a road, and arranging support rails at a predetermined spacing substantially perpendicular to buried rails; forming a support section by connecting the support to the upper portion of each support rail and connecting lower ribs to both sides of the lower portion; stabilizing the ground by providing a concrete to the buried rail; forming a pavement section by integrally mounting the cross beam on the upper portion of each support and by sequentially mounting a lifter or longitudinal bar and an upper assembly thereon; and forming a road surface by paving a road material on the upper surface of the upper assembly.

To achieve the above objects, the underground section includes a plurality of buried rails each having an engaging hole for receiving a bolt therethrough, said engaging hole being elliptical.

To achieve the above objects, the support section includes a plurality of supports of which the lower portion is integrally connected to the support beam by bolts and is supported by lower ribs in a various direction, and a cross beam connected to the upper portion of the support by bolts and is supported by an upper rib.

To achieve the above objects, the pavement section includes a lifter for connecting the cross beam standing on the road surface in the arrangement direction, and an upper assembly connected to the upper portion of the lifter using bolts.

To achieve the above objects, the pavement section may include a prevention wall disposed at both sides of the road along the road in series.

To achieve the above objects, the prevention wall includes a prevention wall support integrally and vertically formed with the cross beams at both ends of the same, and a wall which is connected by the prevention wall support in series.

In the above-mentioned prefabrication type high level road structure, a reinforced beam may be embedded within the underground section at a predetermined portion where is decided based on the strength level of the ground of the underground section.

In this case, the support rail having a shorter length has a predetermined length referring to the width of the road of the construction site, and the reinforced beam has a predetermined length which is substantial for crossing the road.

As another embodiment of the present invention, the support section includes a pair of opposed basic members which are continuously disposed along the roads. These basic members are formed along the center line of the road and are opposed to each other. The concrete is provided between the basic members, thus forming a more stable support. In addition, the support section may includes a support which is perpendicular with respect to the surface. So, the basic member has a groove formed at both ends thereof and the intermediate portion thereof. The support has a lower support in order for the portion being stably engaged with the groove.

The support corresponding to the basic member includes a lower support, which is inserted into the groove of the basic member, formed at both lower ends thereof. A steel concrete is provided at a space formed along the concrete rail, thus stably supporting the support section. The support is basically supported by the basic member. The outer portion of the lower support extended to the outside of the basic member is supported by a wedge. The wedge rod is a trapezoid-shaped concrete.

The support includes a wedge groove mating with the wedge road at the outer lower portion of the lower support.

An anchor inserted into the hole of the basic members passes through the wedge groove, whereby the engagement between the basic member and the support is stable.

The steel of the concrete provided between the basic members is a predetermined cross-sectional view of a circular shape, a reverse trapezoid shape, or a diamond shape.

The basic members, supports, wedge rod and the like are made in the pre-casting method.

As another embodiment of the present invention, the underground section is formed with a pair of opposed basic members which are arranged among the road, and the supports of the support section which are assembled at the intermediate portion thereof is inserted into the intermediate groove of the continuously extended basic member, and a concrete reinformed support are arranged in the groove of both sides of the basic member, with the steel rods which are assembled at the construction site being cross with the basic member.

The fixing member has a predetermined shape corresponding to the lower support of the support. In addition, the lower support of the support protruded and extended to the outside of the fixing member is surrounded by the prevention wall, and the concrete is provided therein.

The lower support of the support includes a predetermined number of engaging holes into which the steel is inserted, or a predetermined end of the steel buried under the ground is exposed to the outside.

The fixing member is assembled in cooperation with the grooves of the basic member in the same manner as the structure adapted for enhancing the engaging force with the prevention wall.

The basic member, the supports, the prevention wall, and the like are made in the pre-casting method.

In accordance with another embodiment of the present invention, a prefabrication type high level road structure includes a pair of opposed basic members which are continuously arranged along the road. These basic members are arranged in parallel, with the concrete being provided in a predetermined space formed between the basic members, thus supporting the support section. The support may be H-shaped, and may be accurately assembled at the opposed basic member.

In this case, the basic member is made in the concrete pre-casting method and is formed by one unit which is composed of two paris and includes a screw engaging portion for a tight engagement with the H-shaped support.

In addition, as anchor bolts are arranged downwardly from the H-shaped spacer, the concrete provided between the opposed basic members is tightly engaged with the support.

In this embodiment, the basic member is made in the concrete pre-casing method.

In accordance with another embodiment of the present invention, the underground section may be composed of a plurality of concrete rails which are arranged on the road surface.

In addition, the support section may includes a cylindrical support which is vertically connected to the lower support portion which is mounted on the concrete rail.

The lower support portion may includes a connection portion formed on the upper portion thereof for connection with the cylindrical support.

Here, a plurality of the concrete rails may be arranged in parallel, and may be formed by one unit which is composed of one pair.

In accordance with another embodiment of the present invention, the prefabrication type high level road structure construction method comprises the steps of forming an underground section by excavating a predetermined area of a road at which the high level road structure is to be built and by disposing spatially opposed basic members at the excavated ground along the road; forming a support section by assembling the lower support to the groove of the opposed basic member; stabilizing the ground by engaging the steel between the underground section and the basic member and by providing the concrete thereto; connecting cross beams on the upper portion of each support and assembling a lifter and an upper assembly thereon; forming a pavement section by paving the road material on the lifter and the upper assembly; and finishing the process by recovering the excavated ground by providing soil or the like and by burying the rail of the underground section.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

FIGS. 11 through 14 are views showing a prefabrication type high level road structure according to a second embodiment of the present invention; of which:

FIG. 11 is a perspective view showing a underground section and a support section;

FIG. 12 is a partial perspective view showing a underground section of FIG. 11;

FIG. 13 is a side cross-sectional view of FIG. 11; and

FIG. 14 is a side cross-sectional view showing an inner curved section of a underground section in accordance with another embodiment thereof;

FIGS. 15 through 17 are view showing a third embodiment, of which:

FIG. 15 is a perspective view showing a reinforcing structure between the underground section and supports according to the present invention;

FIG. 16 is an disassembled perspective view showing another embodiment of the supports of FIG. 15; and FIG. 17 is a partial perspective view showing another embodiment of the reinforcing structure between the underground section and the supports of FIG. 16 according to the present invention;

MODES FOR CARRYING OUT THE INVENTION

Figure 1:
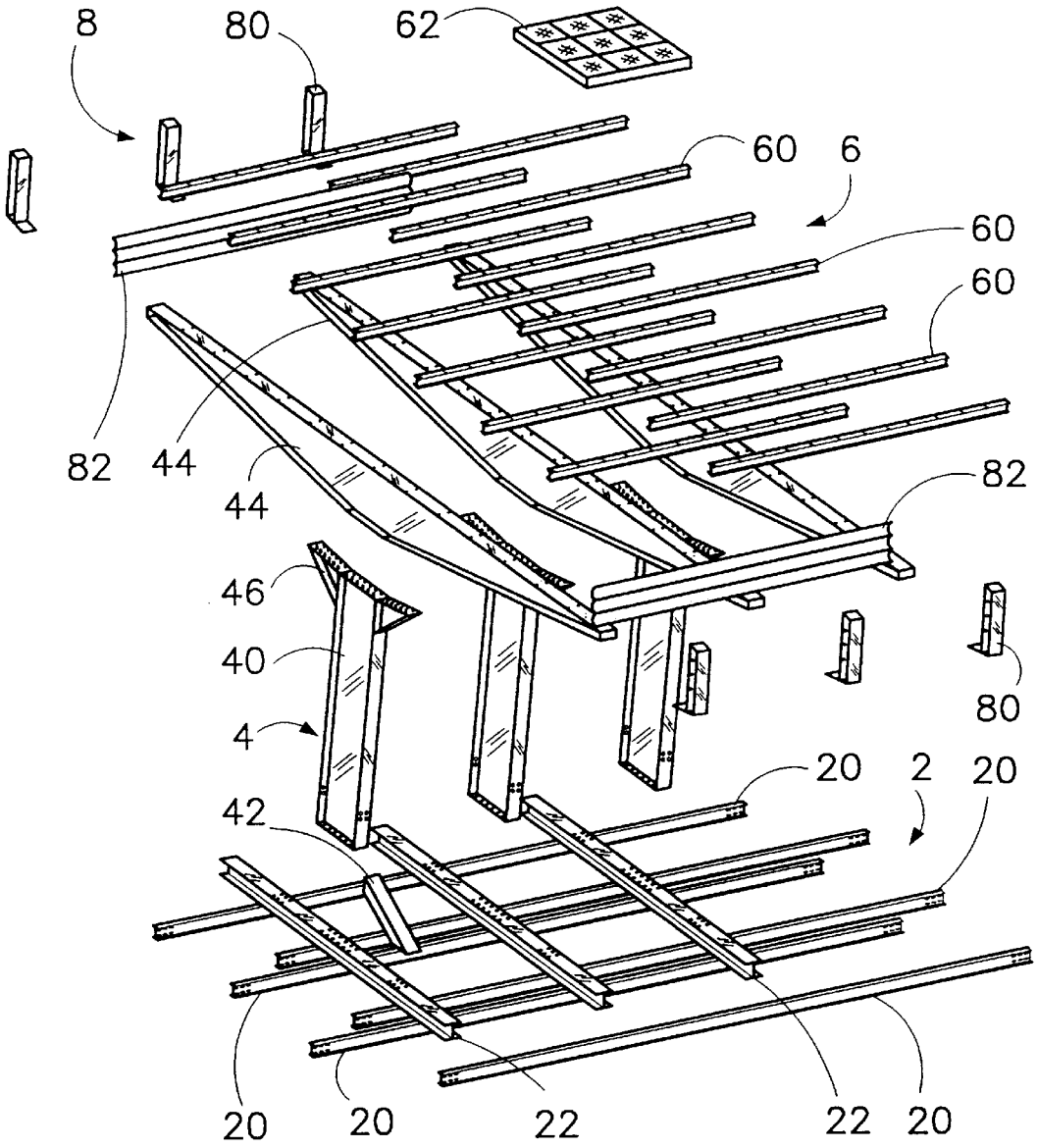
FIG. 1 is an exploded perspective view of important elements of a prefabrication type high level road structure according to a first embodiment of the present invention.

FIG. 1 is an exploded perspective view showing a structure of a prefabrication type high level road or elevated highway according to the present invention, which includes a underground section 2 which is basically buried under the ground, a plurality of spaced-part substantially vertical support section 4 having an upper surface which stand on a road at a predetermined interval from one another, a pavement section 6 formed on the support section 4, and a wall section 8 provided at both sides of the road and being integral with the support section 4.

The underground section 2 includes a plurality of longitudinal bury rails 20 which are parallely buried under the ground oriented in a direction of travel of the high level road, and a plurality of support rails 22 which are perpendicular to the bury rails 20.

Figure 2:
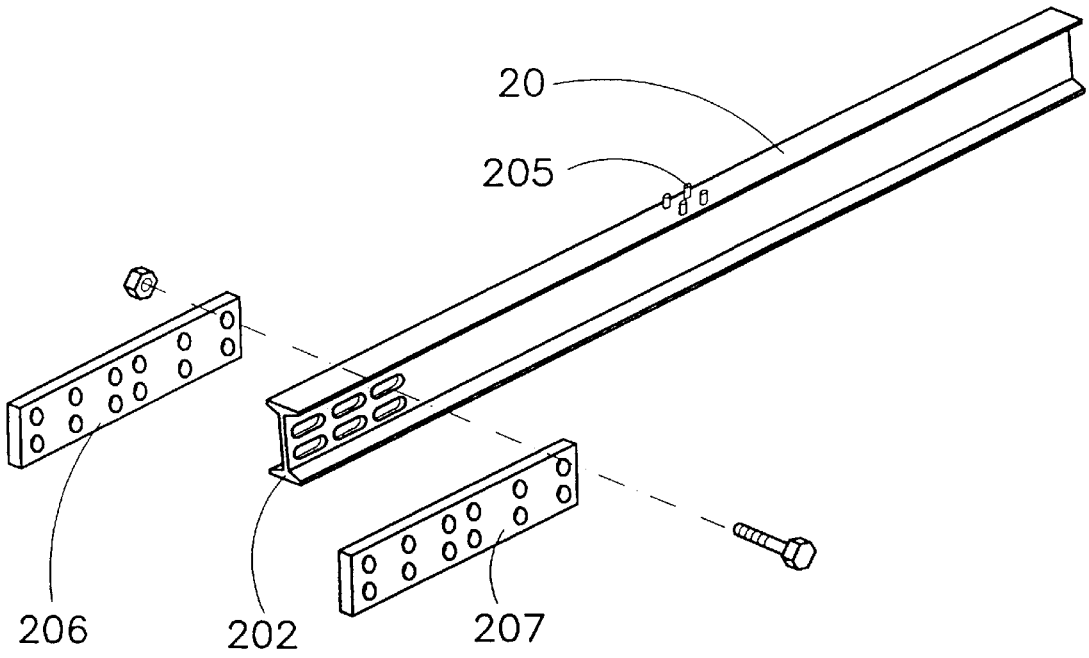
FIG. 2 is a perspective view of a rail which is buried under the ground of FIG. 1 according to the present invention.

As shown in FIG. 2, the bury rail 20 is made of an I-shaped steel, and includes a plurality of elongated holes 202 formed at both ends of the same, and a plurality of fixing bolts 205 formed at the upper surface of the same.

Both sides of a portion in which the elongated holes 202 are formed is engaged with engaging plates 207 and tightened by a plurality of nuts, so that the bury rails 20 are fixedly connected to one another.

The holes 202 of the bury rails 20 are formed to have an elongated portion so as to prevent twist or variation caused due to external impact or temperature applied to the bury rails 20.

In addition, the connection points between the engaging plates 207 and the bury rails 20 are preferably spaced-apart from each other so as to increase the strength of the structure.

As shown in FIG. 1, the support rails 22 perpendicularly connected to the upper surface of the bury rail 20 is integrally connected in cooperation with the fixing bolt 205.

Since the top of the fixing bolts 205 is upwardly protruded for an easy assembly with the support rails 22.

The parallel support rails 22 may have the same length; however, the length of the same may be different from one another based on the ground condition at the construction site.

That is, the short support rail of the support rail 22 has a predetermined length based on the width of the construction area, and the lengthy support rail of the support rail 22 is based on the length across the road surface. That is, a predetermined number of short support rails 22 are provided at every "n"-th lengthy of the support rails 22, and both ends of the same is across the road surface and elongated, so that a more stable structure of the road can be achieved.

The support section 4 perpendicularly stands at the center of the support rail 22.

The support section 4 includes a support 40 of which a lower end is rigidly connected to the support rail 22 using bolts and nuts, a lower rib 42 connected between the support 40 and the support rail 22 at both sides of the lower portion of the support 40, a cross beam 44 placed on the upper portion of the support 40 in a T-shaped form and connected to the support 40 using bolts and nuts, and an upper rib 46 integral with the upper portion of the support 40 for supporting both sides of the cross beam 44.

Figure 3:
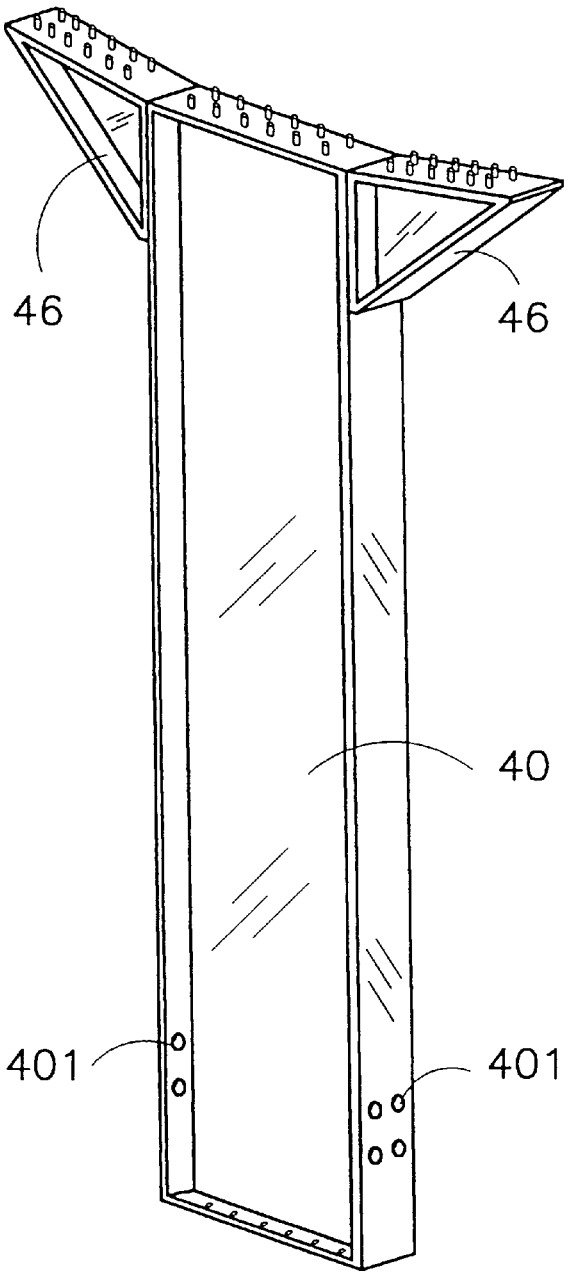
FIG. 3 is a perspective view of a support of FIG. 1 according to the present invention.

As shown in FIG. 3, the support 40 is made of an I-shaped steel, and includes a plurality of holes 401 formed at both lower sides of the same for the connection with the lower rib 42. In addition, the upside-down triangle-shaped upper rib 46 is connected to both sides of the upper portion of the support 40 using bolts and nuts.

Since the upper rib 46 is triangle-shaped, even the upper rib 46 is placed on the support 40, the volume of the same is not increased, so that it is easy to move and mount thereon. Therefore, the upper rib 46 is integrally mounted on the upper portion of the support 40 using the bolts and nuts.

Figure 4:
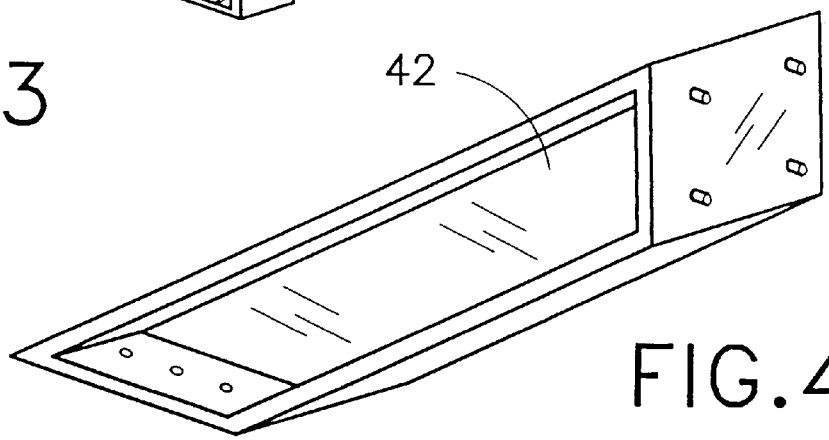
FIG. 4 is a perspective view of a lower rib of FIG. 1 according to the present invention.

Since the lower rib 42 is provided between the support rail 22 and the support 4 in cooperation with a rectangular section, it, as shown in FIG. 4, has a predetermined length. Therefore, it is necessary to separate the assembly into a plurality number of parts for an easy movement and maintenance.

The pavement section 6 is formed on the upper portion of the cross beam 44 after the cross beam 44 is placed on the support 40.

As shown in FIG. 1, the pavement section 6 includes a plurality of parallely spaced-apart bars 60 provided on the upper portion of the cross beam 44, and a plurality of upper assembly members 62 which are placed on the bars 60.

The bars 60 are disposed thereon in the same method as the bury rail 20 of the underground section 2.

Figure 5:
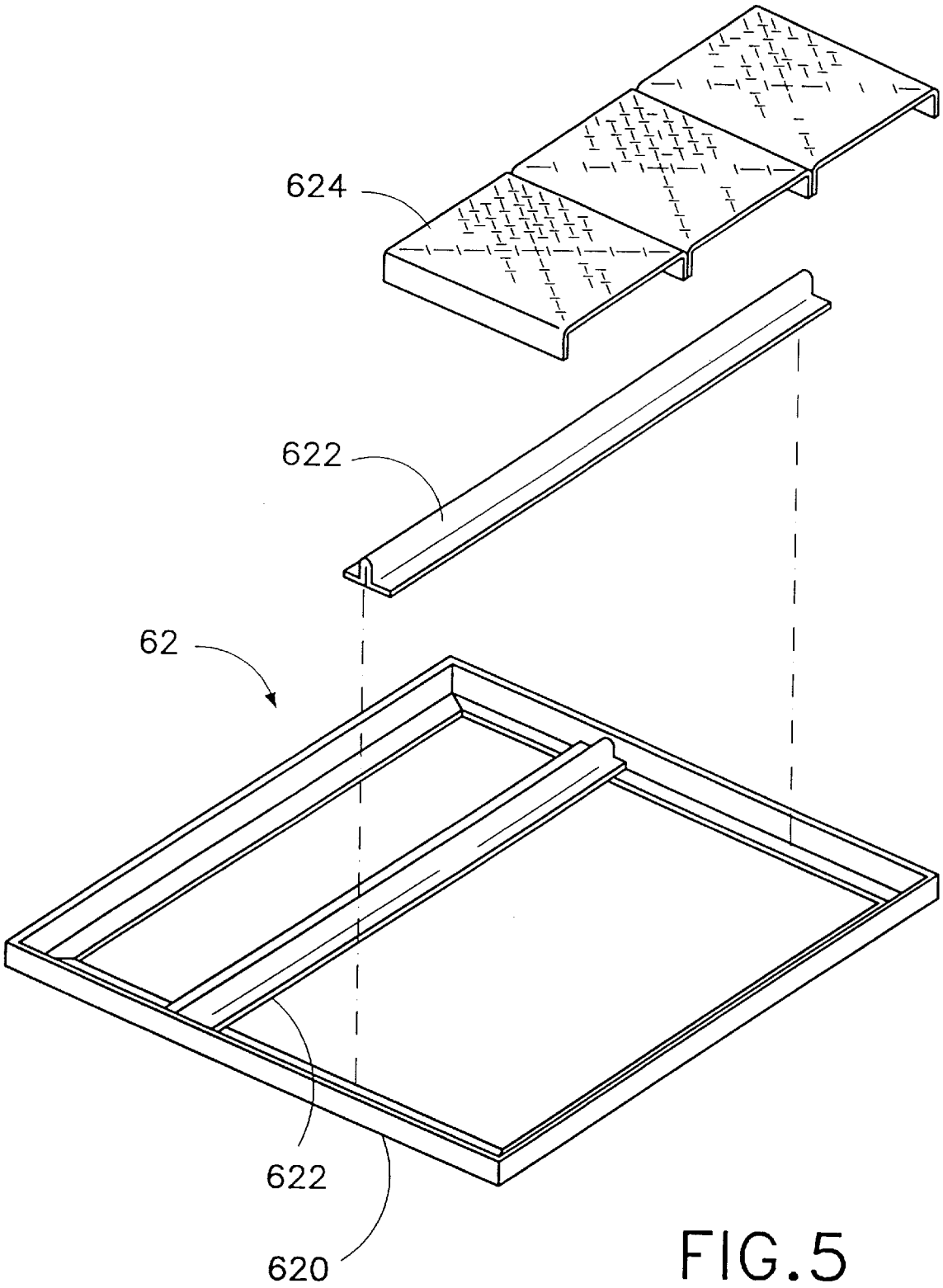
FIG. 5 is an exploded perspective view of an upper assembly of a pavement section of FIG. 1 according to the present invention.

In addition, the upper assembly member 62, as shown in FIG. 5, has a predetermined number of partitions which is partitioned by a separator 622 so as to receive therein a corresponding panel 624. The separator 622 is connected to a predetermined portion of the upper assembly member 62, and the panel 624 is light and has a plurality of protruded lattice-like portions so as to have a desired strength.

As shown in FIG. 1, the wall section 8 includes a wall support 80 vertically formed at both sides of the cross beam 44, and a wall element 82 connected between the wall section supports 80 for forming a wall.

Figure 6:
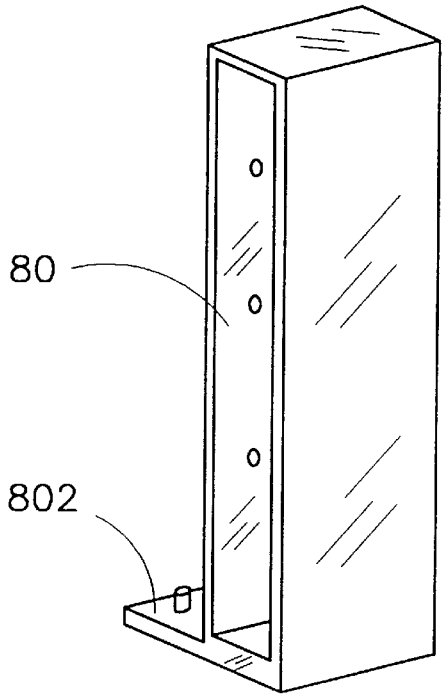
FIG. 6 is a perspective view of a wall support of a wall section of FIG. 1 according to the present invention.

The wall section support 80, as shown in FIG. 6, includes an extended bracket 802 formed at the lower portion of the same. The inclination angle of the bracket 802 coincides with the inclination angle at the lower surface of the cross beam 44, so that the wall section support 80 perpendicularly stands.

Figure 7:
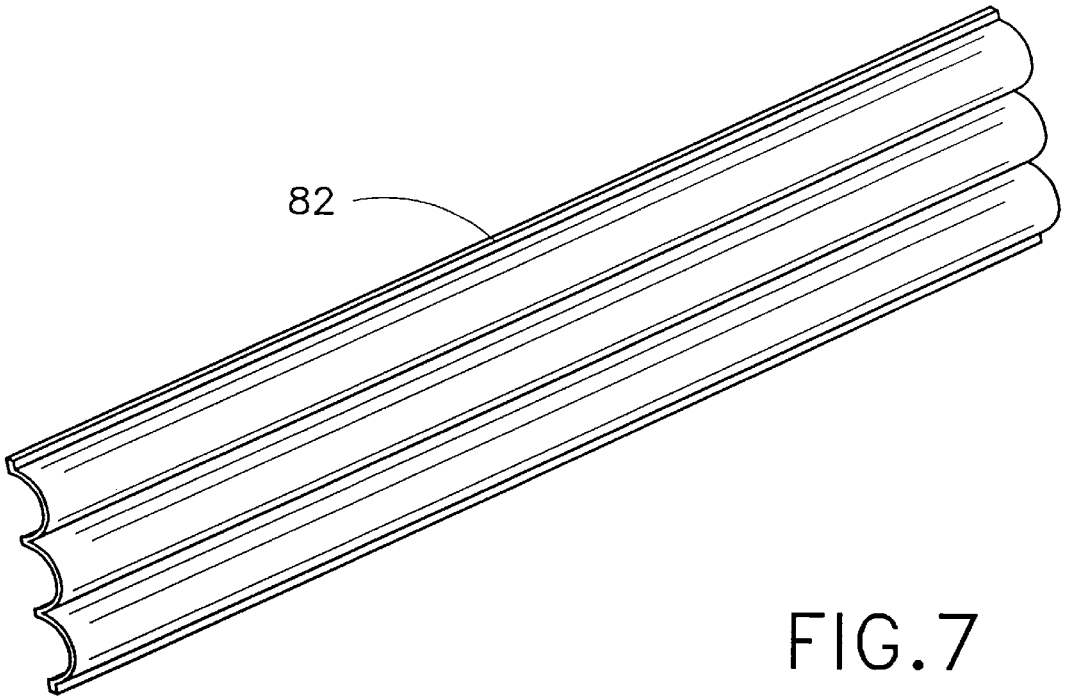
FIG. 7 is a perspective view of a wall element of a wall section of FIG. 1 according to the present invention.

The wall element 82, as shown in FIG. 7, includes wave portions so as to have a predetermined strength.

The bolts used in the structure are exposed to the top of the same for easy assembly and maintenance.

The prefabrication type high level road construction method will now be explained.

[A Underground Section Formation Step]

Figure 8:
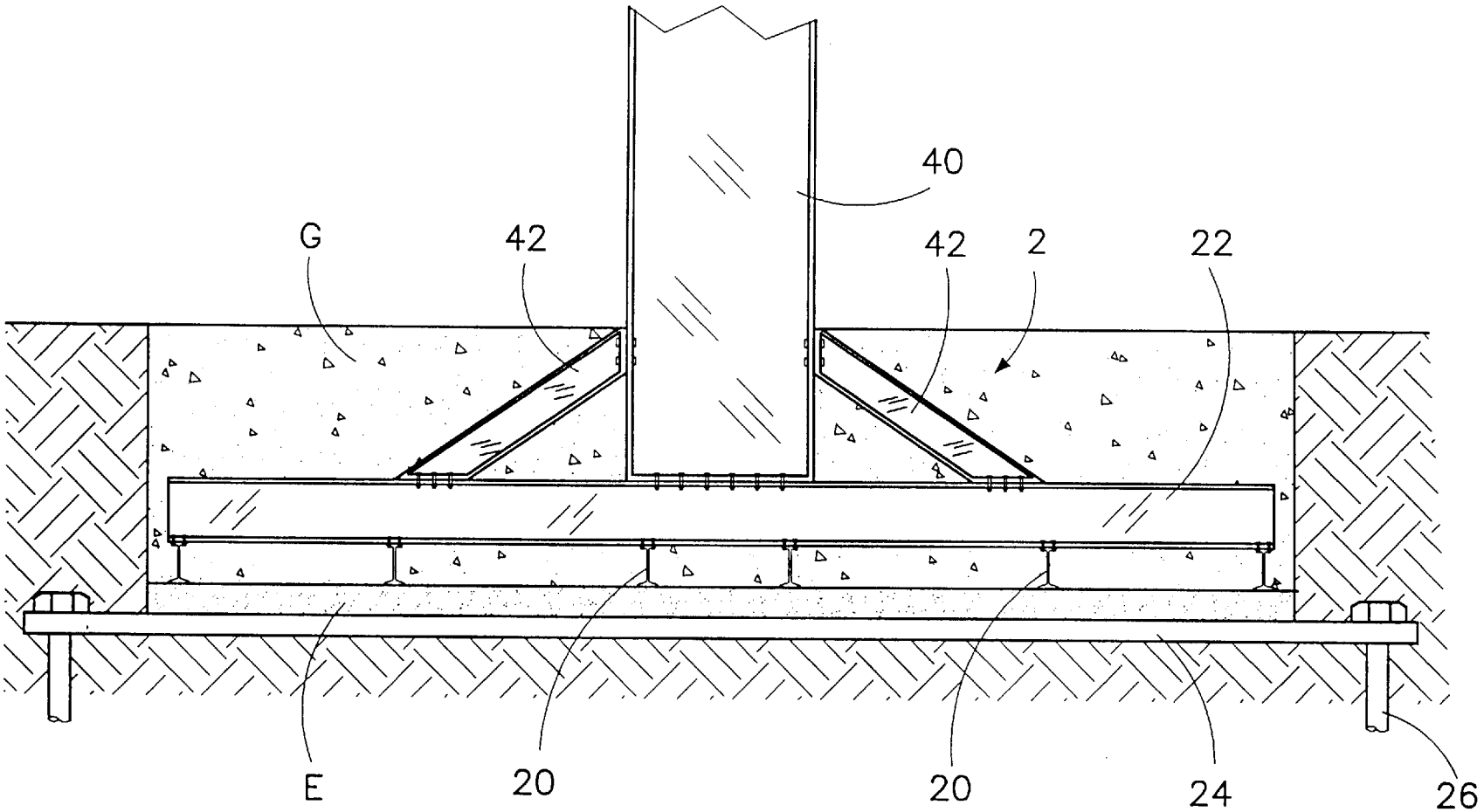
FIG. 8 is a partial cross-sectional view of a construction example of a underground section so as to explain a construction method according to the present invention.

To begin with, a predetermined area E at the ground is prepared for the construction site of the high level road as shown in FIG. 8. Thereafter, the bury rail 20 is buried under the ground along the road. The underground section 2 is formed by arranging the bury rails 20 and the support rails 22 in the previously described manner. The support 40 stands at the center portion of the support rail 22, and the lower ribs 42 is connected to both sides of the same.

[A Ground Stabilizing Step]

Thereafter concrete backfill is provided to the underground section so as to form a buried layer G, thus stabilizing the area in which a high level road is to be constructed.

[A Pavement Section Formation Step]

Figure 9:
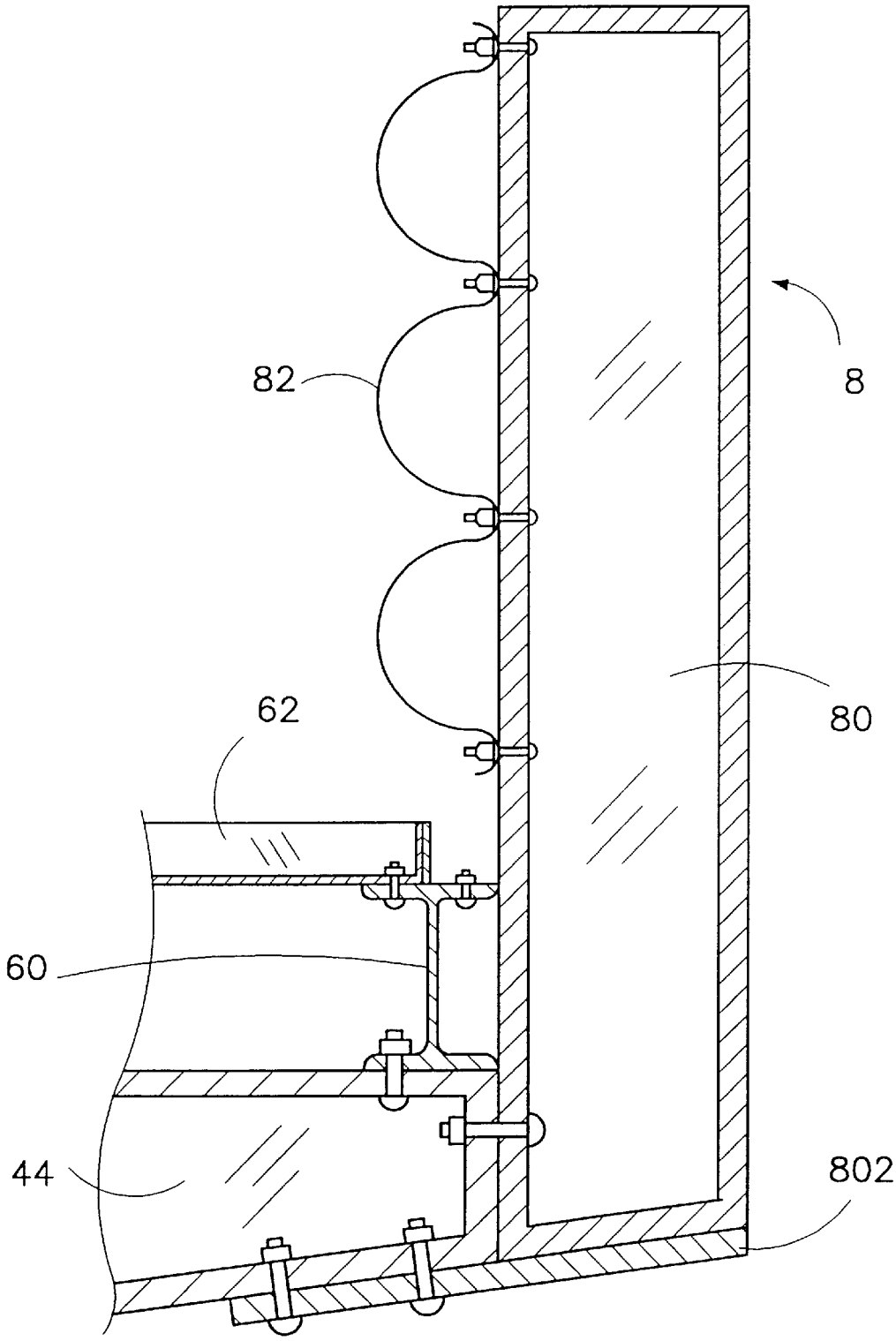
FIG. 9 is a partial cross-sectional view of an assembled state of a wall section of FIG. 1 according to the present invention.

When the buried layer G in which the concrete is provided is substantially hardened, the cross beam 44 is placed on the upper portion of each support 40 and is integrally connected thereto. In addition, as shown in FIG. 9, the bracket 802 of the wall section support 80 are integrally connected to both ends of the cross beam 44, and the wall section elements 82 are connected to one another in series so as to form the wall section 8, and in addition, the bars 60 and the upper assembly member 62 are provided on the upper surface of the cross beam 44.

Here, the cross beam 44 or the wall section support 80 are generally moved to the corresponding position using a crane machine or the like. When constructing the road, the bury rail 20 may be used as a path for the crane machine so as to reduce the occupying area of the construction site.

[A Road Surface Pavement Step]

Figure 10:
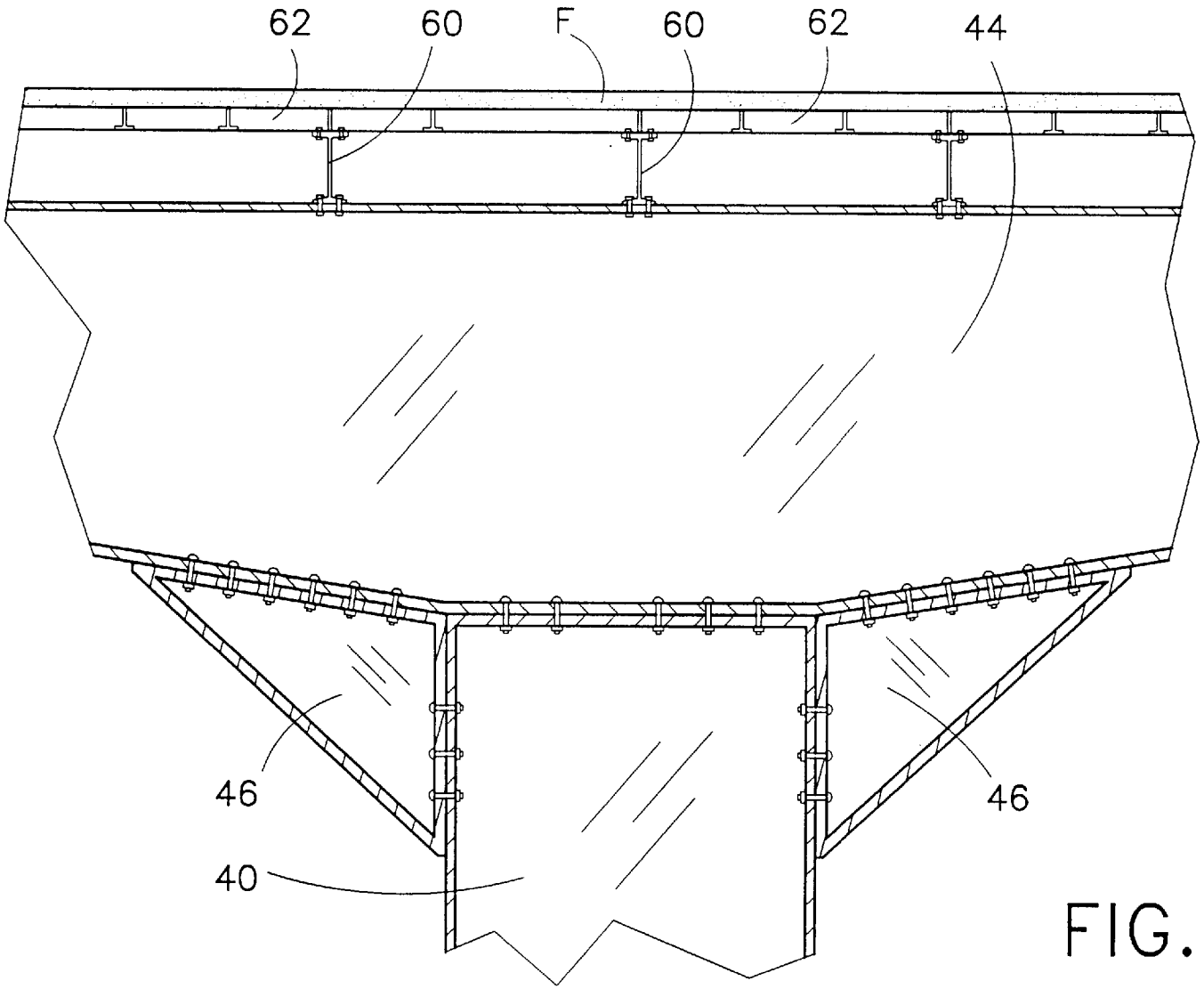
FIG. 10 is a partial cross-sectional view of a pavement section so as to explain a construction example according to the present invention.

As shown in FIG. 10, a road surface of the high level road is formed on the upper surface of the bars 60 using a road material F as shown in FIG. 10. Here, the pavement of the road material F is performed in the usual method.

As described above, the prefabrication type high level road structure and a construction method thereof according to the first embodiment of the present invention includes the underground section 2 buried under the ground, the support 4 which vertically stands at the underground section 2, and the pavement section 6 formed on the upper surface of the support 4, and the wall section 8 formed at both sides of the road to be constructed. Here, the underground section 2, the support 4, the pavement section 6, and the wall section 8 are detachably connected to one another. In addition, since the weight of the entire structure of the road is applied to the ground through the above-mentioned elements, the weight is not directly applied to the ground, and the weight is applied to a plurality of supports, so that the support can resist up a desired resistance. In addition, since the weight is not applied to one support, the weight applied thereto can be effectively distributed. Moreover, it is possible to fabricate a support 40 in a smaller size as compared to the conventional art, so that the occupying area can be reduced and the road using rate can be maximized.

In addition, it is possible to significantly shorten the construction period as compared to the conventional construction method since the formation step of the underground section and the other step are performed only once.

In particular, it is possible to fabricate all elements having a standard size in a mass production, so that it is easy to move the elements to the construction site and assembly the elements at the same time, thereby reducing an occupying area at the construction site and effectively reducing the traffic jam as compared to the conventional art.

In addition, since many of the elements are made of an I-shaped steel, the weight of the structure is light, and it is easy to move the structure to the construction site.

In addition, since many of the elements are integrally set up from the underground section 2 buried under the ground, the structure can resist up against earthquake and the like, and it is possible to standardize the element size.

The present invention is not limited to the above-described structure.

FIGS. 11 through 14 show a second embodiment of the present invention.

Figure 11:
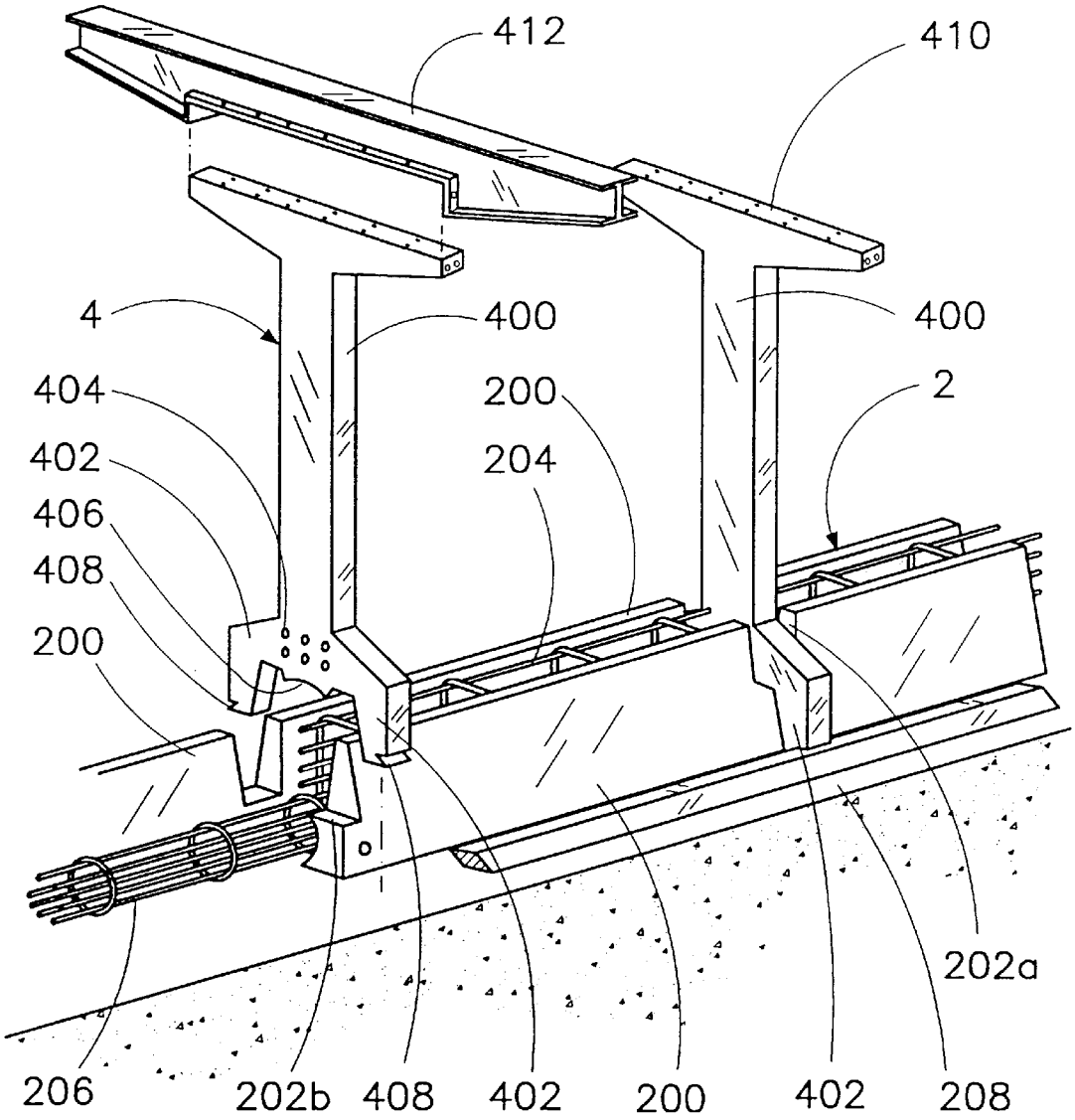

FIG. 11 shows the construction of the second embodiment of the present invention, of which the ground support section 2 includes a pair of opposed basic or foundation members 200 which are disposed along the road in series.

The pair of basic members 200 are opposingly disposed along the center line of the road, and the steel and concrete are provided therebetween and then forms a predetermined construction which is capable of stably supporting the support section 4. In addition, the support section 4 includes a support 400 which is accurately and vertically inserted at a predetermined portion of the basic member 200 which are opposingly disposed.

The basic member 200 for engaging with the support 400 includes grooves 202*a* and 202*b* formed at both ends of the same and at the intermediate portion of the same. The support 400 includes a lower support 402 outwardly protruded to both end sides thereof with respect to the structure of the basic member 200 and then accurately inserted into the grooves 202*a* and 202*b*.

In addition, a plurality of engaging holes 404 into which the steel 204 is inserted and arranged are formed at the lower support 402 of the support 400, with the steel 204 passed through the lower support 402 being buried within the concrete provided between the basic members 200.

A spacer 406 for limiting the arranging space between the basic members 200 is integrally protruded at the bottom portion of the lower support 402.

In addition, the steel arranged between the basic members 200 may be separated to the upper and lower portions of the lower steel 206 except for the upper steel 204. In this case, the lower steel 206 is individually arranged irrespective of the upper portion thereof.

The support 400 is rigidly supported by the basic member 200. More preferably, a wedge rod 208 is inserted to the outer side of the lower support 402 which is outwardly extended to the outside of the basic member 200.

The wedge rod 208 is parallelogram-shaped and is formed of a steel-concrete. A wedge groove 408 is formed at the lower outer portion of the lower support 402 for a more rigid engagement with the lower support 402.

In the upper rib 410 of the support 400, a plurality of nuts or bolts are buried as in the first embodiment, and the cross beam 412 is placed thereon thereby and is more stable supported.

Figure 12:
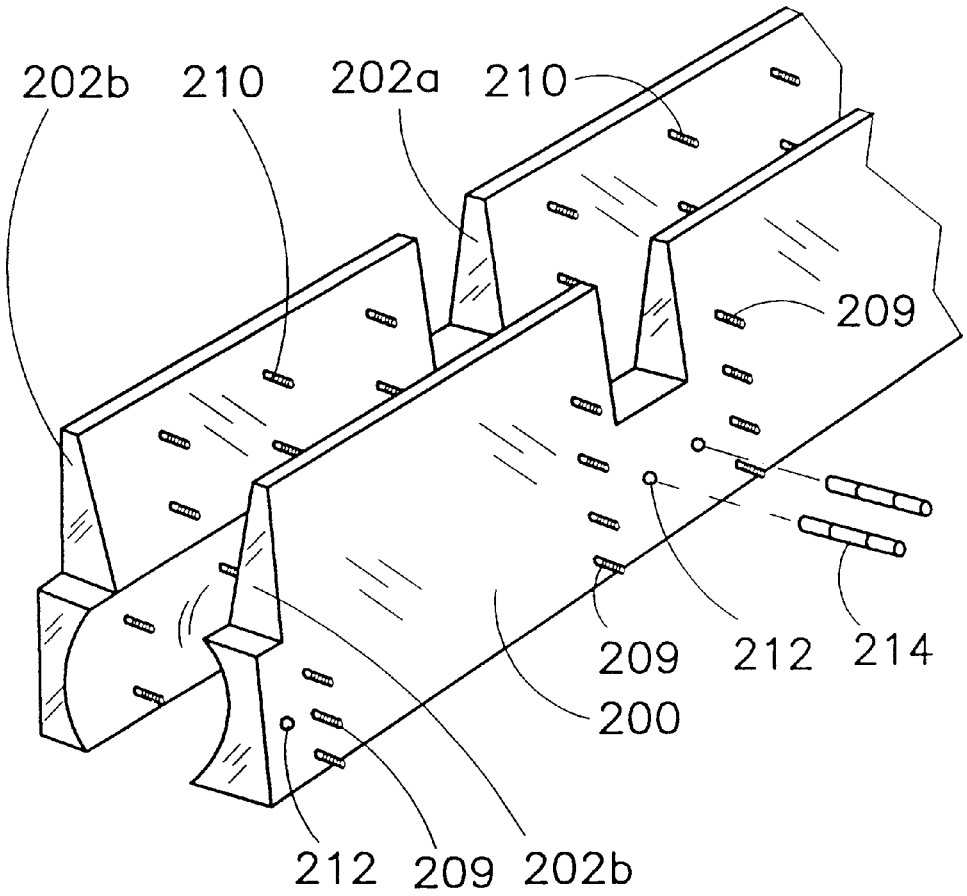

FIG. 12 shows the construction of the basic member 200.

The basic member 200 has a predetermined construction in order for the engaging surface with the concrete provided between the curved portion to be defined. In addition, the basic member 200 may be engaged with the steel 204 by extending a part 210 of the buried steel 204 so as to increase the strength with the concrete which is provided at the construction site.

In addition, the groove 202*a* formed at the intermediate portion of the basic member 200 remains its original form, however, since the groove 202*b* formed at both sides thereof has a semi-portion, when it is connected to the groove 202*b* of the basic member 200, a complete groove is obtained.

Meanwhile, a through hole 212 is formed at the lower portion of the grooves 202*a* and 202*b*, in which the anchor 214 is inserted.

Figure 13:
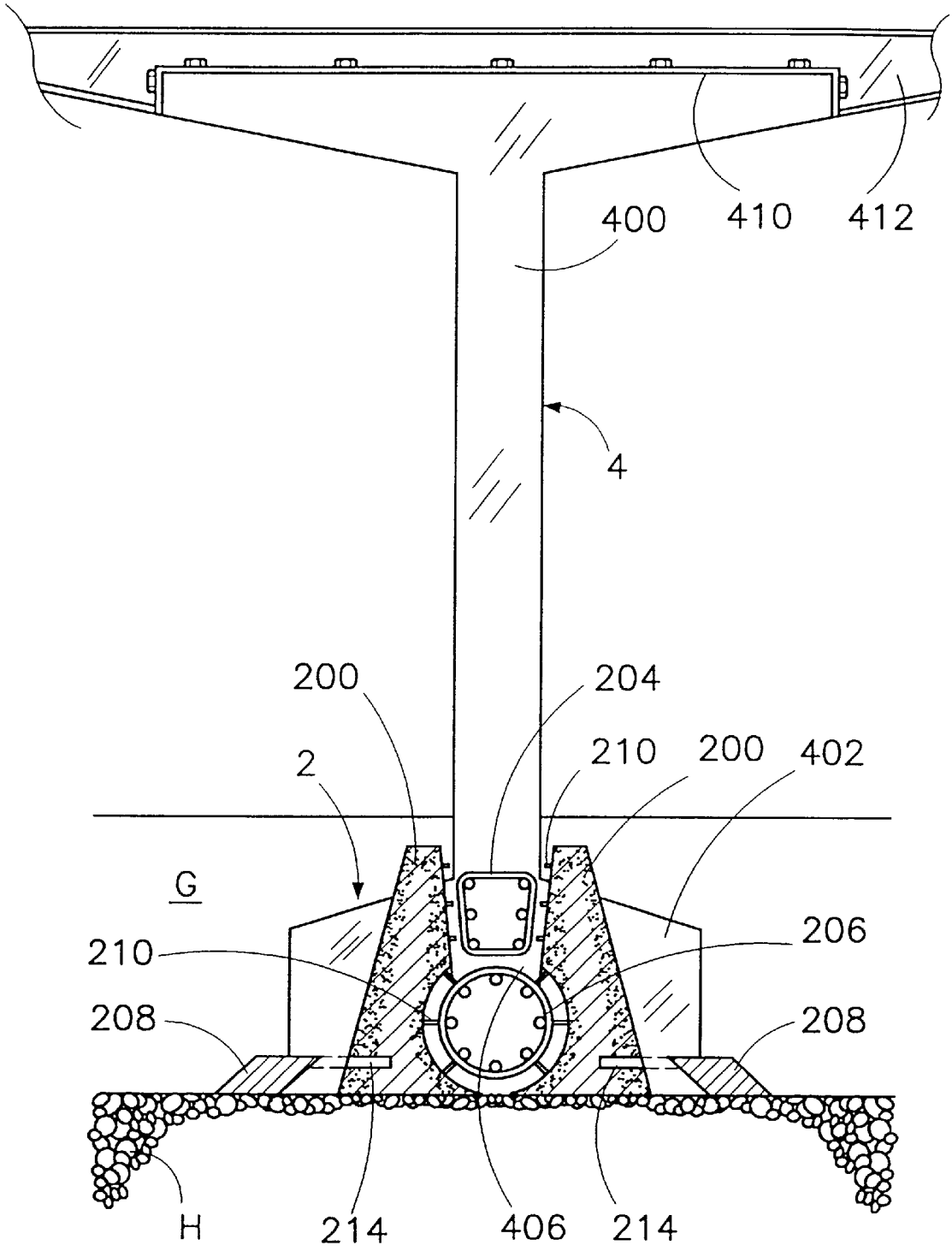

As shown in FIG. 13, the anchor 214 is inserted into the wedge groove 408 of the support 400, so that the connection between the basic members 200 and the lower support 402 can be more stable.

FIG. 13 shows the side cross-sectional view of the assembly construction according to the second embodiment of the present invention.

In the space formed by the basic member 200, the upper steel 204 and the lower steel 206 are arranged. the upper steel 204 and the lower steel 206 are not always separated. They may be united.

The upper and lower steels 204 and 206 are connected with the buried steep 210 which is extended to the inner portion of the basic member 200, so that the upper and lower steels 204 and 206 can be more stable with respect to the basic members 200.

Figure 14:
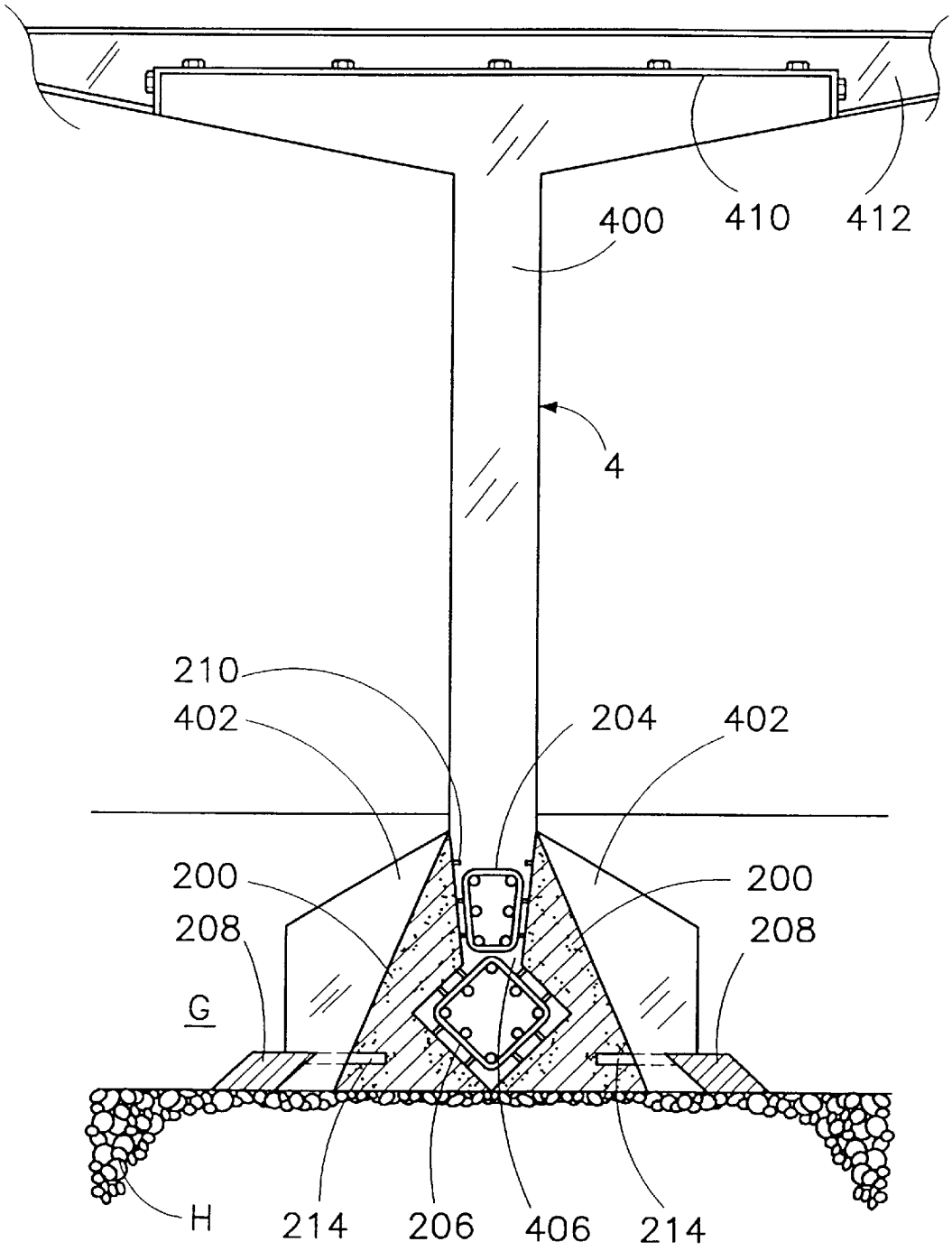

The upper and lower steels 204 and 206 are formed in a upside-down trapezoid shape, or circle. In addition, it may be formed in a diamond shape which is shown in FIG. 14.

In addition, the steel 204 is inserted into the engaging hole 404 of the support 400 which is engaged to the grooves 202*a* and 202*b* of the basic member 200.

Preferably, a predetermined shaped pipe is inserted into the engaging hole 404 and then the concrete is provided therein during the precasting of the support 400.

Since the support 400 supports the basic members 200 in cooperation with the spacer 406 protruded toward the intermediate portion of the lower support 402 when the support 400 is assembled within the basic members 400, a predetermined distance between the basic members 200 is obtained.

As shown in FIGS. 13 and 14, the wedge rod 208 is inserted into the wedge groove 408 formed in the lower support 402 of the support 400. The anchor 214 inserted into the through hole 212 of the basic members 200 through the wedge groove 408 of the lower support 402 is supported by the wedge rod 208.

Thereafter, the upper portion of the basic members 200 and the lower support 402 are buried with soil or the like, and forms the buried layer G.

In this embodiment, the basic member, the support, the wedge rod, and the like are built in the steel concrete precasting method at another site. Therefore, at the construction site, they are only assembled, thus shortening the construction period and reducing the construction site occupying area.

The pavement section 6 and the wall section 8 are installed on the supports 4 which are planted in the underground section 2 in the same manner of the first embodiment.

Figure 15:
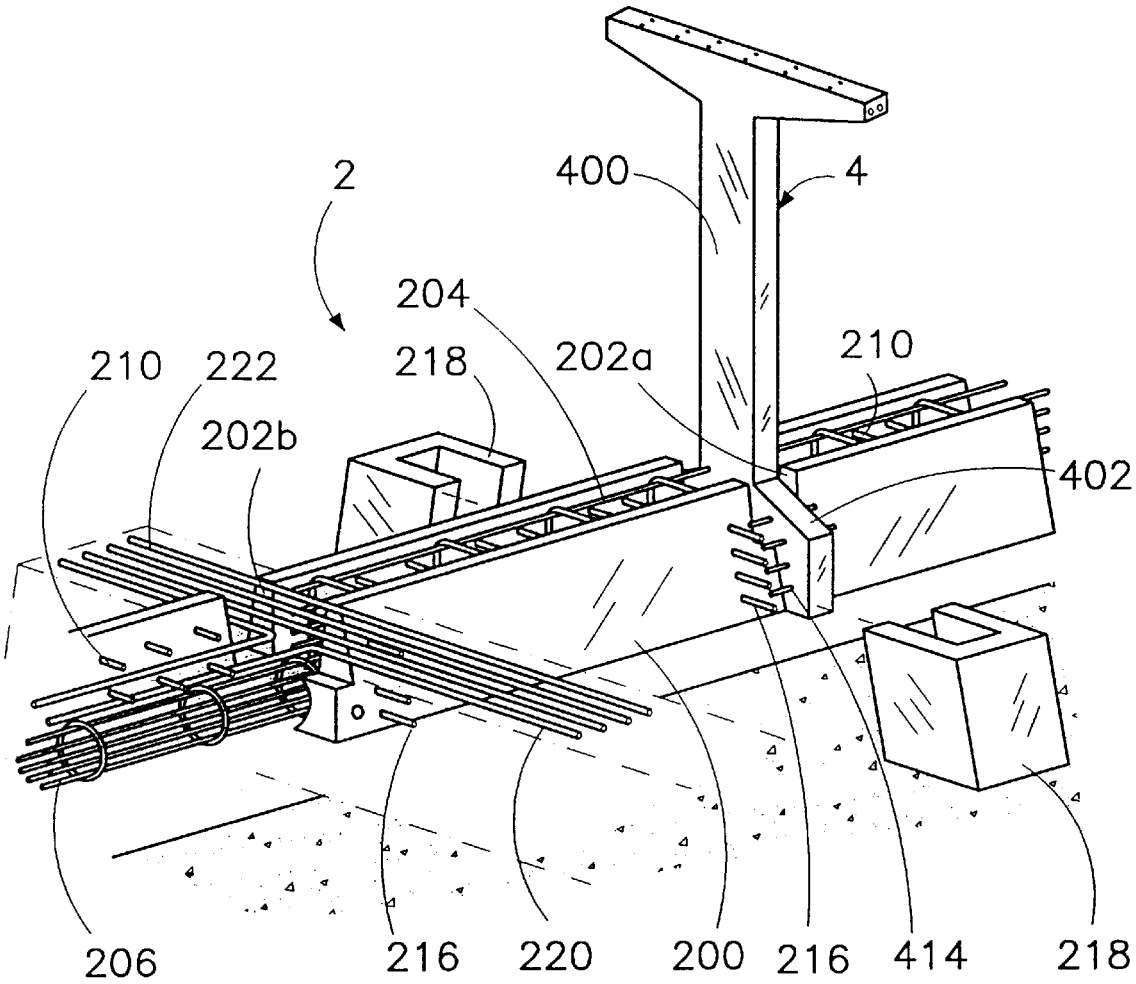
Figure 16:
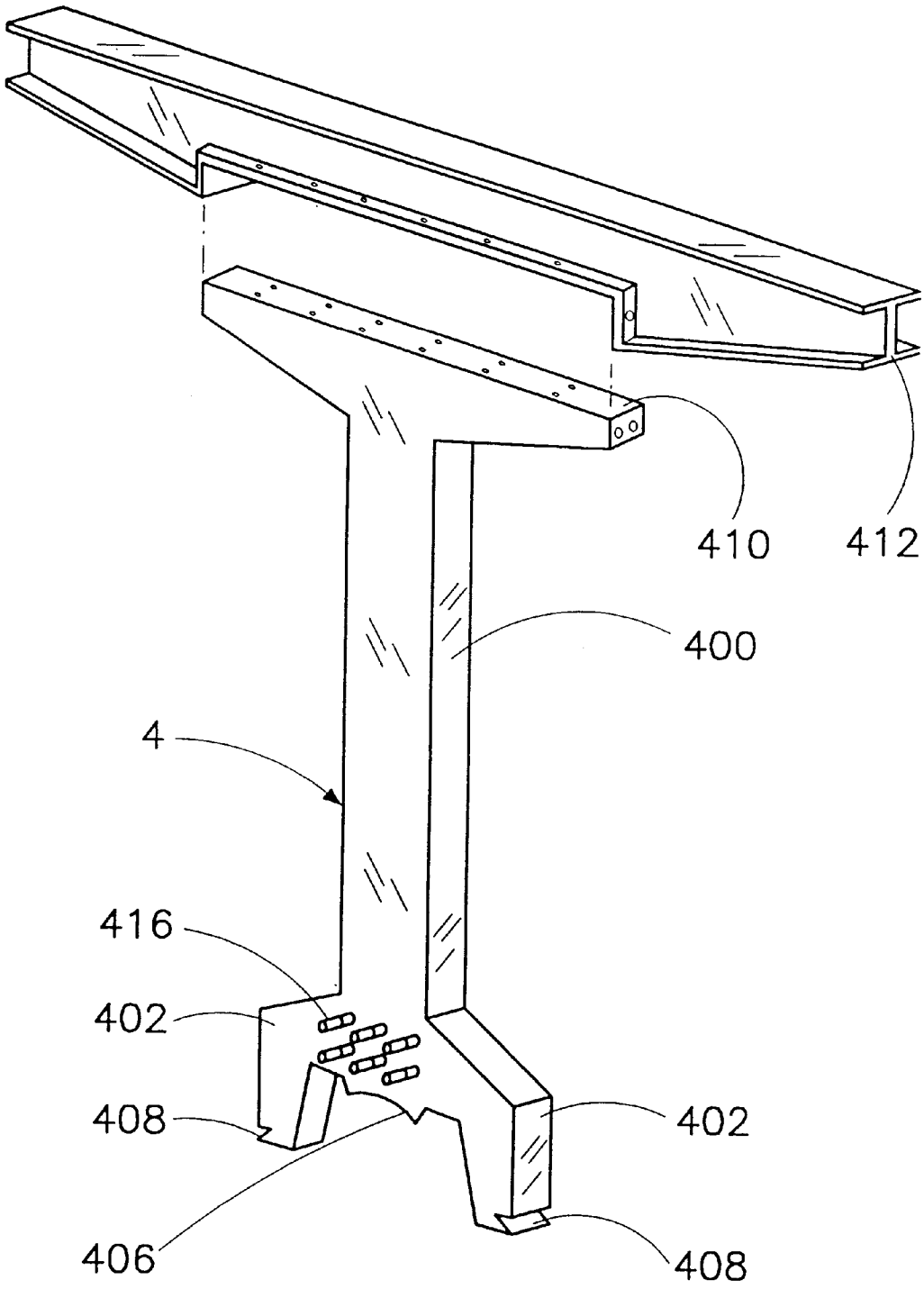
Figure 17:
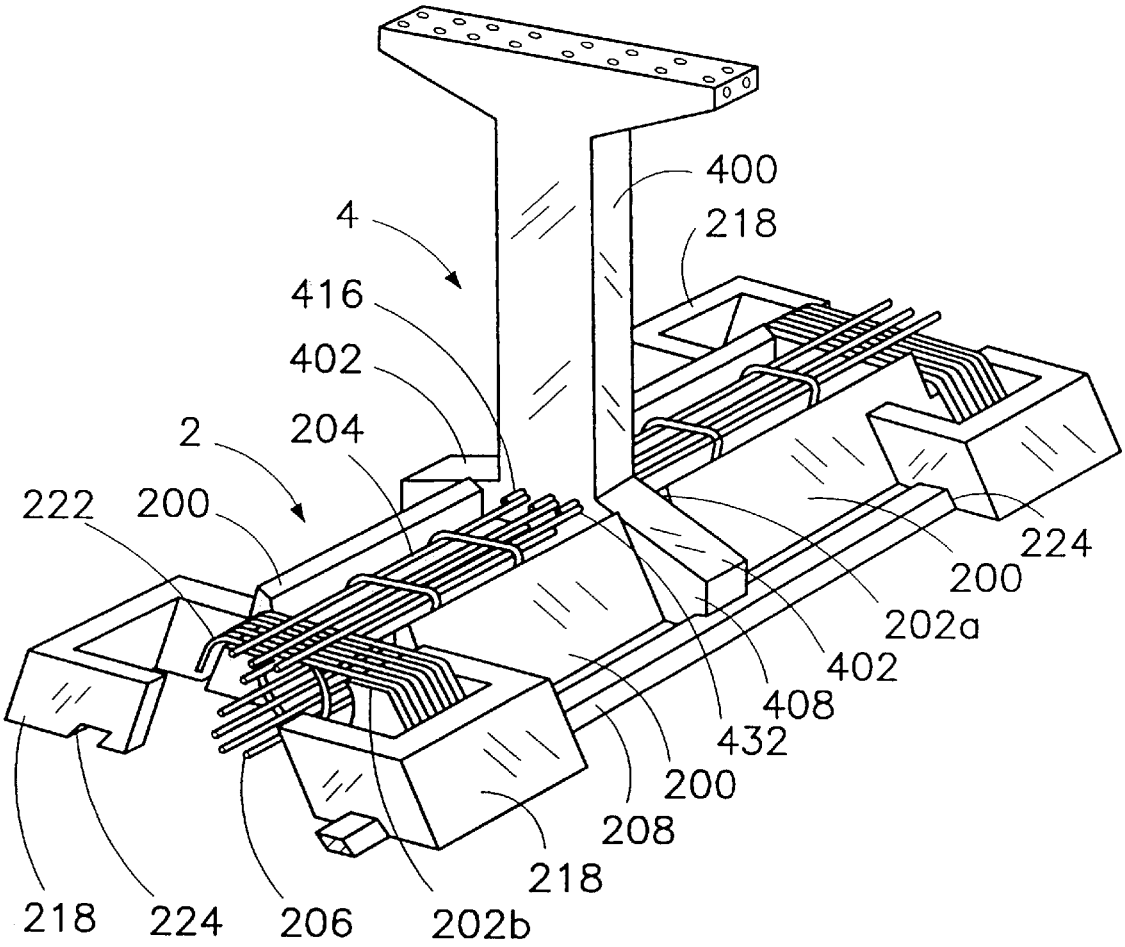

FIGS. 15 through 17 show the prefabrication type high level road structure and a construction method thereof according to the second embodiment of the present invention.

FIG. 15 shows that the support 400 is integrally assembled with the basic members 200.

The support 400 includes first outwardly extended protrusions 414 from the lower support 402 inserted into the groove 202*a* of the basic member 200 and second outwardly extended protrusions 216 at the periphery of the groove 202*a*.

The thusly outwardly extended protrusions 216 and 214 are surrounded by a prevention wall body 218 and defines a predetermined space. In addition, the concrete is provided in the above-mentioned space, so that the lower supports of the support 400 is integral with the basic member 200.

Meanwhile, the reinforcing steel 222 may be crossingly arranged in the groove 202*b* of the basic member 200, and the concrete reinforcing support 220 is provided at the periphery of the reinforced steel 222 which is indicated by the one-dot-one-line.

Here, the protrusion 216 is outwardly and partially extended at the periphery of the groove so that the reinforcing steel 222 and the basic member 200 can be united more stable, thus uniting the protrusion 216 with the reinforcing steel 222.

The concrete reinforcing support 220 is crossingly extended with respect to the basic member 200, thus achieving a more stable ground condition and an excellent load distribution effect.

A part 416 of the buried steel is extended between the lower support 402 as shown in FIG. 16 in the support 400. The space 406 is integrally extended at the lower side thereof, and a wedge groove 408 is formed at the outer lower portion of the lower support 402, and may be changed to the construction that the cross beam 412 is fixed by the upper rib 410.

Of course, the pavement section 6 and the wall section 8 are constructed on the cross beam 412 in the same manner of the first embodiment according to the present invention.

As shown in FIG. 17, the support 400 is assembled by the basic member 200.

As shown in FIG. 17, the underground section 2 includes a pair of basic members 200 which are opposingly arranged along the rod, and the basic member 200 includes grooves 202*a* and 202*b* which are engaged with the support 400 of the support section 4.

The support 400 is inserted into the groove 202*a* of the basic member 200, and the reinforcing steel 222 is crossingly arranged in the groove 202*a*.

The reinforcing steel 222 is engaged with the upper and lower steels 204 and 206 which are spatially arranged between the basic members 200, and the prevention wall 218 surrounds the arrangement and the concrete is provided therein.

The wedge rod 208 is inserted into the wedge groove 408 of the support 400 before assembling the prevention wall 218. In addition, the prevention wall 218 is preferably engaged by pressing the upper portion of the wedge rod 208, and the prevention wall 218 includes a slot 224 to which the wedge rod 208 is engaged.

In addition, a part of the buried steel of the support 400 is integrally engaged with the upper and lower steels 204 and 206 which are arranged between the basic members 200.

The above-described construction may be used for a softly curved high level rod in a view that the connection portion of the basic member 200 can be more stable.

The construction method of the prefabrication type high level rod structure according to the second embodiment of the present invention is as follows.

A Underground Section Formation Step

A predetermined area is evacuated at the existing road, and rocks and the like are provided in the thusly evacuated area, and then the surface H of the evacuated area is made flat, and the opposed basic members are arranged along the road in parallel, at which the high level road is built, to be spaced-apart between the basic members, and then the underground section is constructed.

A Support Formation Step

The lower portion of the support is engaged to the groove of the basic member, thus constructing the support, the concrete is provided in the space defined by the prevention wall member in order for the connection between the basic member and the support to be stable and strong.

The distance between the basic members is referred as the spacer formed at the intermediate portion of the lower surface of the lower support.

A Ground Stabilizing Step

The concrete is provided in the space defined between the basic member and the prevention wall, so that the basic members and the supports become stable, thus stabilizing the ground at which the support is to be built.

A Pavement Section Formation Step

The cross beams are mounted on the support and are connected to one another, and the upper assemblies are mounted thereon in order, and then connected to one another, thus forming the pavement section.

A Road Surface Pavement Step

The upper surface of the upper assembly is paved in the conventional method.

A Finishing Step

The road evacuated in the underground section formation step is filled by the soil, thus substantially embedding the basic members within the underground section.

The subject matters of the present invention are not limited to the above-mentioned embodiment which is directed to planting the support between the opposed basic members.

Figure 18:
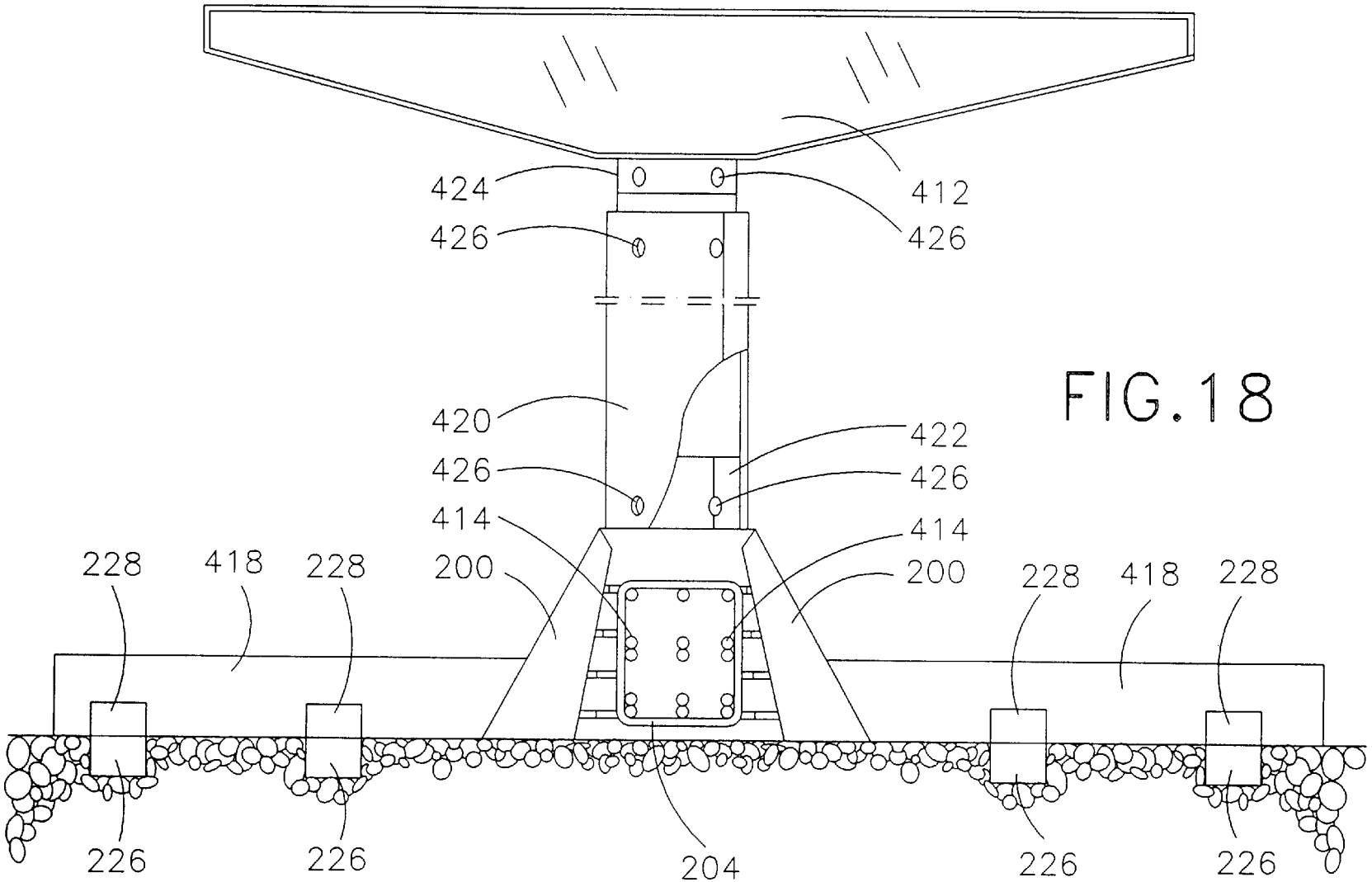
FIG. 18 is a plane view showing the third embodiment of the present invention.
Figure 19A:
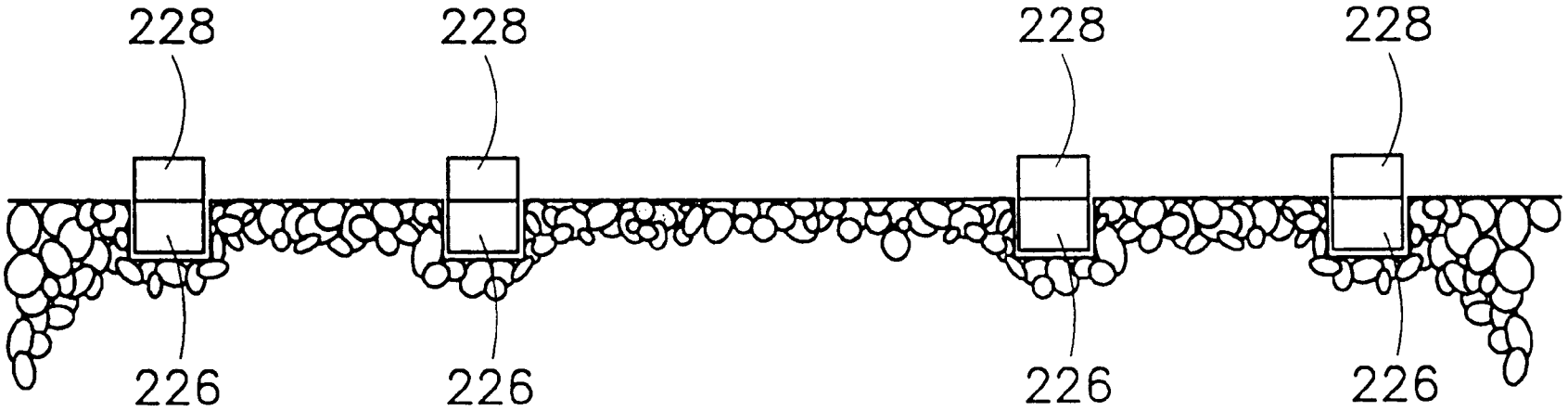
FIG. 19A is a fault plane view showing a basic constructing state of the underground section according to the third embodiment of the present invention.
Figure 19B:
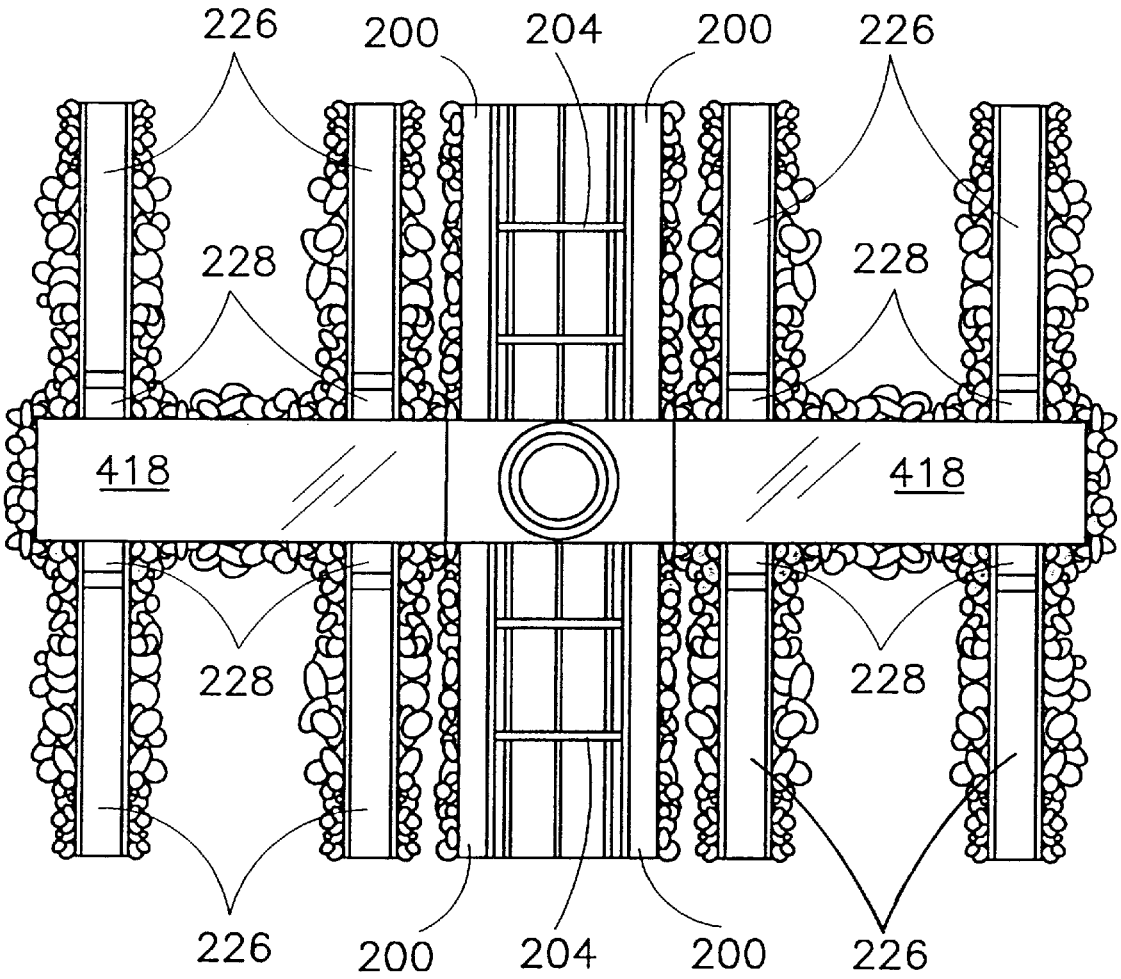
FIG. 19B is a plane view of FIG. 19A.
Figure 20:
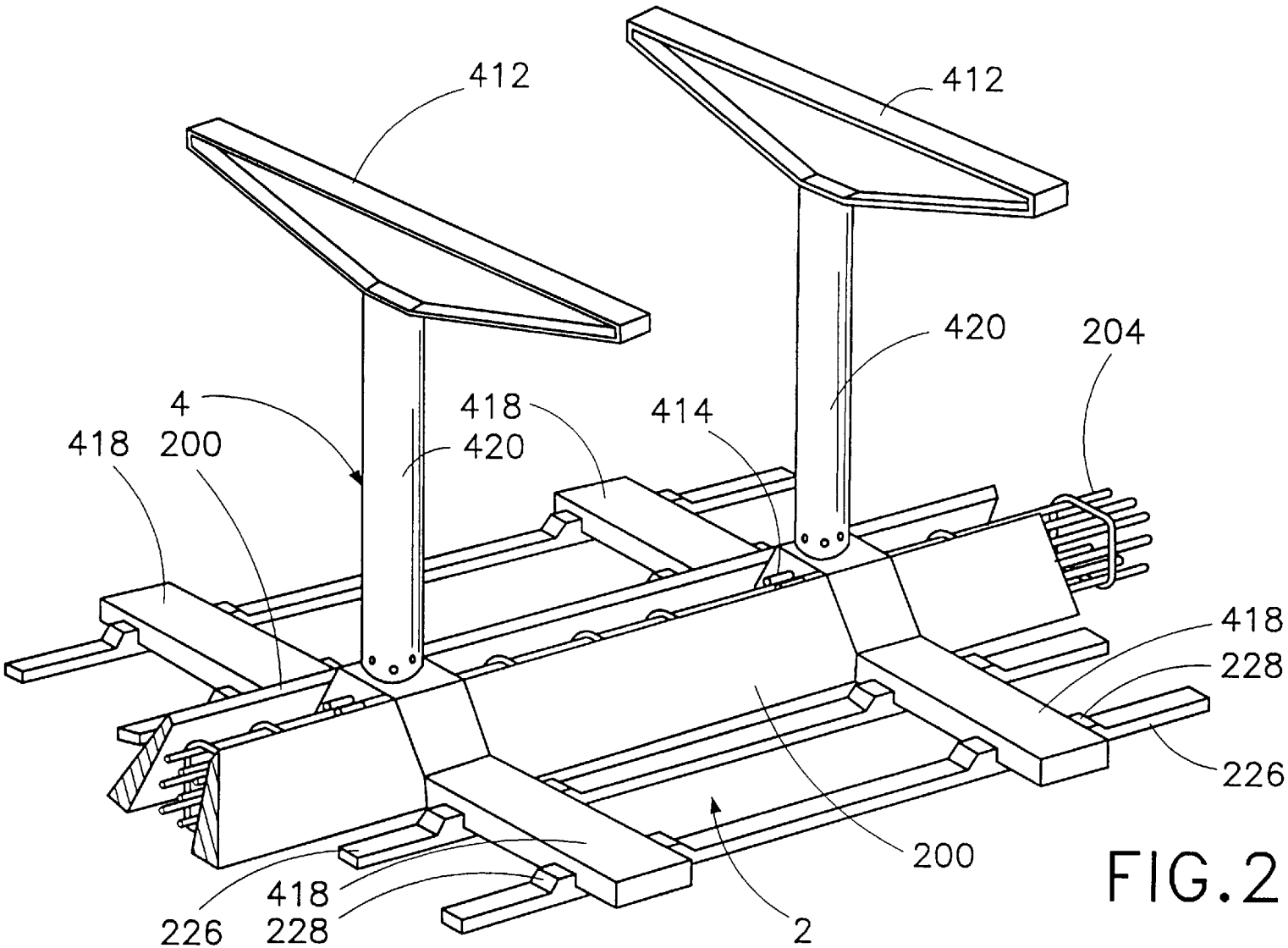
FIG. 20 is a perspective view showing a construction state according to a third embodiment of the present invention.

FIGS. 18 and 20 show a prefabrication type high level road structure and a construction method thereof according to a third embodiment of the present invention.

In the third embodiment, the underground section 2 includes a plurality of concrete rails 226 which are arranged in parallel.

The above-described construction is useful for evenly distributing the load of the structure and cars to the surrounding area of the road when subway structure or communication cable structure are formed therein.

The support section 4 includes a hollow support 420 which is vertically installed at the intermediate portion of the lengthy support 418 which can be crossingly installed with respect to the concrete rail 226.

The concrete rails 226 which are arranged in parallel includes a protrusion 228 mating with the lower portion of the lengthy support 418. The above-mentioned structure is shown in FIG. 20.

The lengthy support 418 has a part 414 of the buried steel at both sides of the intermediate portion thereof, and the hollow support 420 includes a lower side connection portion 422 which is engaged to the lower center portion thereof.

In addition, the upper surface of the hollow support 420 is connected with the upper connection portion 424 fixed to the lower surface of the cross beam 412.

The hollow support 420 is engaged with the engaging hole 426 formed on the outer portion of the upper and lower connection portions 422 and 424 using rivets, is stably fixed in the horizontal and vertical directions.

Meanwhile, after a pair of basic members 200 are installed between the lengthy supports 418, and the concrete is provided in the space defined between the lengthy supports 418, and the upper steel 204 is integrally united.

The basic member 200 is arranged in its length direction, and a part of the buried steel 210 is engaged with the upper steel 204.

In this embodiment, the excavation of the surface for the underground section 2 may be at the place where the concrete rail 226 is installed.

The lengthy supports 418 is arranged on the upper surface of the concrete rail 226 which is arranged in the excavated region, and the concrete rail 226 is arranged at a predetermined place so that the protrusion 228 of the concrete rail 226, as shown in FIG. 20, is inserted to the lower portion of the lengthy supports.

When the assembly is finished, the concrete rail 226 is buried by soil, and the lengthy support 418 forms a part of the road.

The construction method of a prefabrication type high level road according to the third step will now be explained.

A Underground Section Formation Step

A predetermined area where the concrete rail can be arranged is evacuated at the existing road, and the concrete rails are arranged in parallel and forms the underground section.

A Support Formation Step

The lengthy supports are crossingly arranged on the concrete rails which are arranged in parallel, and the hollows supports are vertically connected to the lower connection section which is disposed at the intermediate portion of the lengthy support, and then the support section is formed.

A Ground Stabilizing Step

The pair of the basic members are opposingly arranged between the lengthy support of the support section, and the steel is arranged therebetween, thus stabilizing the ground where the support is to be installed.

A Pavement Section Formation Step

The cross beams are mounted on the support and are connected to one another, and the upper assemblies are mounted thereon in order, and then connected to one another, thus forming the pavement section.

A Road Surface Pavement Step

The upper surface of the upper assembly is paved in the conventional method.

A Finishing Step

The road evacuated in the underground section formation step is filled by the soil, thus substantially e basic members of the underground section.

As described above, the present invention is basically directed to significantly reducing the construction period.

In particular, all elements which are assembled at the construction site can be made at another site far away from the construction site of the high level road, so that it is possible to standardize the size and requirement of the elements. In addition, it is possible to reduce the occupying area of the construction site by bring the necessary element from another area where the elements are made to the construction site of the high level road, thus preventing the traffic jam at the construction site.

In addition, the present invention is directed to using an "I"-shaped steel or a precasted concrete construction which have a high strength and is light in weight, it is possible to more easily convey and handle it.

Moreover, since all the elements are integrally connected to the underground section which is buried under the ground, it is possible to more stable structure of the high level road which is stable against earthquake.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A prefabrication type high level or elevated road structure, comprising:

an underground section for stably supporting the total weight of the high level road structure and vehicles thereon and for distributing the total weight thereof, said underground section including a plurality of buried beams which are buried under a ground surface and a support rail perpendicular to said plurality of buried beams and connected thereto;

a plurality of supporting sections vertically standing along a right-of-way and spaced-apart from one another by a predetermined distance, said supporting sections being connected to said underground section, each of said supporting sections including (a) at least one vertical support of which a lower portion is integrally connected to a respective support rail by bolts and is supported by lower ribs each having a major longitudinal axis oblique to major longitudinal axes of said rail and of said support section respectively and (b) a cross beam connected to an upper portion of the respective vertical support; and a paving section mounted on said supporting sections.

2. The structure of claim 1, wherein said underground section includes a plurality of buried rails each having an engaging hole for receiving a bolt therethrough, said engaging hole being elliptical.

3. The structure of claim 1, wherein said underground section includes a reinforced beam buried beneath a ground surface for stabilizing the high level road structure.

4. The structure of claim 3, wherein said reinforced beam is secured beneath said ground surface by anchors at opposite ends of said reinforced beam.

5. The structure of claim 1, wherein said pavement section includes:

a plurality of bars for connecting cross beams of respective supporting sections in a longitudinal direction along said right-of-way; and an upper assembly connected to an upper portion of said plurality of bars by bolts.

6. The structure of claim 5 wherein said pavement section includes a prevention or retaining wall disposed at opposite sides of said high level or elevated road structure.

7. The structure of claim 6, wherein said prevention or retaining wall includes:

a prevention or retaining wall support integrally and vertically formed with said cross beam at both ends thereof; and a wall which is connected to said prevention or retaining wall support.

8. A prefabrication type high level or elevated road structure having a pavement section, at least one vertical support, a pair of basic members which are opposed along a road or right-of-way, and a steel frame in a space formed between the basic members, the support being rigidly supported by or anchored to said basic members and said steel frame by a concrete mass disposed in said space, a cross beam and longitudinal bars being assembled to an upper side of the support.

9. The structure of claim 8, wherein said steel frame has a predetermined shape taken from the group consisting of a circle, a trapezoid and a diamond.

10. The structure of claim 8, wherein said basic members and said support are pre-cast.

11. The structure of claim 8, wherein each of said basic members has grooves formed at opposite ends thereof and an intermediate portion thereof.

12. The structure of claim 11, wherein said support includes a lower support portion, which is inserted into one of the grooves of each of the basic members.

13. The structure of claim 8, wherein said support has a lower support portion integral with the concrete mass which is provided in the space between the basic members.

14. The structure of claim 13, wherein said lower support portion has an outer part extended to an outside of the basic members, said outer part being engaged by a wedge-shaped rod.

15. The structure of claim 13, wherein said lower support portion includes a predetermined number of engaging holes into which parts of the steel frame are inserted.

16. The structure of claim 13, wherein one end portion of said steel frame is buried and another end portion of said steel frame is exposed.

17. The structure of claim 8, wherein said support includes a lower support portion having an outer part provided with a wedge-shaped groove mating with a wedge-shaped rod.

18. The structure of claim 17, wherein said wedge-shaped rod is made of steel-reinforced concrete and has a cross-section in the shape of a parallelogram.

19. The structure of claim 17, wherein said wedge-shaped groove is passed through an anchor inserted into holes in the basic members, whereby an engagement between the basic members and the support is stabilized.

20. In a prefabrication type high level or elevated road structure, an assembly comprising a pair of opposed basic members provided along a road or right-of-way, a support inserted into grooves formed at intermediate portions of the basic members, a steel cross piece engaging grooves at opposite ends of the basic members, and a prevention or retaining wall disposed along an outer side of one of said basic members to define a space containing outer parts of said support and of said cross piece, a concrete mass being provided in said space.

21. In a prefabrication type high level road structure, an assembly comprising (a) a plurality of lengthy or elongate supports crossingly arranged with respect to a plurality of concrete rails which are arranged in parallel, (b) a hollow support installed at an intermediate position of the lengthy or elongate supports, (c) a pair of basic members opposingly arranged between the lengthy or elongate supports, (d) a concrete mass provided in a space formed by the plurality of lengthy or elongate supports, the hollow support and the pair of basic members, and (e) a cross-beam and (f) bars assembled on a top portion of the hollow support for receiving a pavement section.

22. The structure of claim 21, wherein at least one of said lengthy or elongate supports includes a connection section at an upper and intermediate portion of said one of said lengthy or elongate supports for a connection with the hollow support.

23. The structure of claim 21, wherein said lengthy or elongate supports each have a part of steel exposed at a side surface of an intermediate portion of the respective lengthy or elongate support for a rigid connection with the concrete mass.

24. A prefabrication type high level road structure construction method, comprising the steps of:

forming an underground section by excavating a predetermined area of a road or right of way at which the high level road structure is to be built and by disposing spatially opposed basic members at the excavated ground along the road or right of way;

forming a support section by assembling a lower support to a groove in an opposed basic member;

disposing a steel piece in a space between the basic members and introducing concrete into said space, thereby stabilizing said underground section and said support section;

connecting a cross beam to an upper portion of said support section and assembling bars and an upper assembly on said cross beam;

forming a pavement section by paving a road material on the bars and the upper assembly; and burying the underground section.

25. A prefabrication type high level road structure construction method, comprising the steps of:

forming an underground section by excavating a predetermined area of a road at which the high level road structure is to be built and by arranging a plurality of concrete rails in parallel on the excavated ground;

forming a support section by crossingly arranging a plurality of lengthy or elongate supports on an upper portion of the parallel arranged concrete rails and by vertically connecting a hollow support to a connection portion of an upper portion of an intermediate support of the lengthy supports;

providing steel pieces in a space which is formed by opposingly forming a pair of basic members between the lengthy or elongate supports and providing a concrete mass therein and stabilizing the ground;

engaging a cross beam on a top portion of each hollow support, assembling bars and an upper assembly body thereon for forming a pavement section;

paving commonly used road materials on an upper surface of the upper assembly body; and finishing the process by providing soils an the excavated portion during the underground section formation process and burying the concrete rails.

26. The method of claim 25, wherein said excavated area of the underground section is filled by rocks and is made substantially flat.

27. A prefabricated elevated highway structure, comprising:

a pair of elongate foundation members disposed along a foundation trench;

a framework of reinforcing members disposed in a space formed between said pair of elongate foundation members;

vertical support members arranged at predetermined intervals along said elongate foundation members, rigidly joined to said foundation members and said reinforcing members by concrete disposed within said space;

substantially horizontal cross beams joined to upper surfaces of said vertical support members for supporting an elevated roadway, said cross beams having transverse arms; and a plurality of elongate longitudinal stringers disposed between successive transverse arms of respective said cross beams for supporting a paving surface of said elevated roadway.

28. The structure of claim 27 wherein said framework of reinforcing members has a predetermined cross-sectional shape drawn from the group: circle, trapezoid, diamond.

29. The structure of claim 27 wherein said foundation members and said vertical supports are formed of pre-cast concrete.

* * * * *